US006540110B2

(12) United States Patent
Weiser

(10) Patent No.: US 6,540,110 B2
(45) Date of Patent: Apr. 1, 2003

(54) DISPENSING DEVICE FOR FLOWABLE MATERIAL

(76) Inventor: Manuel Weiser, Veilchenstrasse 3a, D-76131 Karlsruhe (DE)

( * ) Notice: Subject to any disclaimer, the term of this patent is extended or adjusted under 35 U.S.C. 154(b) by 0 days.

(21) Appl. No.: 10/030,355

(22) PCT Filed: May 3, 2001

(86) PCT No.: PCT/EP01/04948

§ 371 (c)(1),
(2), (4) Date: Jun. 4, 2002

(87) PCT Pub. No.: WO01/85000

PCT Pub. Date: Nov. 15, 2001

(65) Prior Publication Data

US 2002/0162855 A1 Nov. 7, 2002

(30) Foreign Application Priority Data

May 8, 2000 (EP) ..... 00109689

(51) Int. Cl.[7] ..... B65D 35/28
(52) U.S. Cl. ..... 222/103; 222/107; 222/181.3
(58) Field of Search ..... 222/92, 95, 103, 222/105, 107, 181.3

(56) References Cited

U.S. PATENT DOCUMENTS 3,741,439 A 6/1973 Vehrs ..... 222/103
4,163,509 A * 8/1979 Amneus ..... 222/95
4,424,917 A * 1/1984 Berger et al. ..... 222/103
4,650,452 A * 3/1987 Jensen ..... 493/206
5,000,350 A * 3/1991 Thomsen ..... 222/103
5,067,635 A 11/1991 Thomsen ..... 222/103
5,791,521 A * 8/1998 Kitamura et al. ..... 222/107
5,806,717 A 9/1998 De Rosenzeig ..... 222/105
5,845,813 A * 12/1998 Werner ..... 222/101
5,857,592 A * 1/1999 Hyldgaard et al. ..... 222/96

FOREIGN PATENT DOCUMENTS

DE 89 15 054.6 1/1990

* cited by examiner

*Primary Examiner*—Joseph A. Kaufman

(57) ABSTRACT

Apparatus for dispensing product capable of flowing out of a bag which contains a supply chamber, an apportioning chamber, a connecting passage between the chambers and a discharge passage. The bag can be suspended in the dispensing apparatus. A squeezing device of the dispensing apparatus contains an abutment wall, against which the bag butts, and hand-actuated pressure-exerting parts, including a hand lever and a pressure-exerting pivoting member, which clamp in the bag in the region of the apportioning chamber and squeeze it out in the direction of the discharge passage.

9 Claims, 5 Drawing Sheets

DISPENSING DEVICE FOR FLOWABLE MATERIAL

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to an apparatus for dispensing a product capable of flowing out of a bag, particularly liquid soap and the like.

TECHNICAL FIELD

A dispensing device for dispensing liquid substance from a pouch is known from PCT WO 95/23546. Portions of the liquid substance are pressed out of the bag, which contains a supply chamber and an apportioning chamber, which are connected to one another by a passage. The discharge passage is of self-sealing design and is opened by an inwardly directed pressure which is exerted by a pivotably mounted plate when a pressure-exerting element is pressed onto the apportioning chamber by means of a lever. In this design, there are pivotable supporting plates for the apportioning chamber which are supported resiliently on the housing rear wall, and there is a hand-actuated angle lever as pressure-exerting element in order to press onto the apportioning chamber and squeeze out the liquid substance or free-flowing product through the discharge passage. It is not so easy to make a functioning self-sealing discharge passage in a bag. Furthermore, spring supported leverage in a dispensing apparatus is liable to break down.

SUMMARY OF THE INVENTION

It is an object of the present invention to provide a simplified design of the dispensing apparatus.

It is a further object of the present invention to provide a dispensing apparatus which does not require a self-sealing outlet passage.

Use is made of a bag with product capable of flowing, which may be, for example, washing lotions, in particular having antimicrobial properties, care lotions and disinfectants. The product bag comprises two sheets which have an upside-down bottle- or pear-shaped outline and are welded to one another at their borders and over surface areas. There are formed in this case a top surface-area fastening strip with two snap fasteners, two central surface-area constricting locations for forming a through-passage between a top supply chamber and a bottom apportioning chamber, and two bottom surface-area constricting locations for forming an outlet or discharge passage. The bag is distinguished in that the bottom constricting locations have approximately rhomboidal surface areas, the larger base side of the rhombus being located on the outside of the bag and the smaller base side being adjacent to the outlet passage. The oblique sides of the rhombus lead in a funnel-shaped manner in the direction of the outlet passage. The bottom surface-area constricting locations, moreover, have snap fasteners for fastening the bag on an abutment wall of the dispensing apparatus.

The dispensing apparatus itself contains a squeezing device, which is formed by the abutment wall and hand-actuated pressure-exerting members. These hand-actuated pressure-exerting members contain a hand lever, which is mounted such that it can be pivoted about a first axis, and a pressure-exerting pivoting member, which is mounted about a second axis. The pressure-exerting pivoting member is arranged in a pivotable manner at a predetermined distance from the abutment wall, a wedge-shaped interspace being formed in the process. In the starting position, the wedge is wide at the top and narrow at the bottom, with the result that the bag, which hangs with its apportioning chamber in the wedge-shaped interspace, is kept closed in the bottom region at the outlet opening by the wedge narrowing.

Upon actuation of the band lever, the pressure-exerting pivoting member is displaced such that the conditions at the wedge-shaped interspace reverse: the top end of the interspace tapers in a wedge-shaped manner and the bottom end widens in a funnel-like manner. By virtue of this operation, the quantity of product enclosed in the apportioning chamber is squeezed out of the outlet opening.

When the hand lever is released, the conditions reverse again, that is to say the interspace between the pressure-exerting pivoting member and abutment wall once again takes on a downwardly tapering shape, as a result of which the outlet is closed and the free-flowing product flows down thereafter from the supply region into the apportioning region.

BRIEF DESCRIPTION OF THE DRAWINGS

The invention will be described with reference to the drawing, in which.

DETAILED DESCRIPTION

Figure 1:
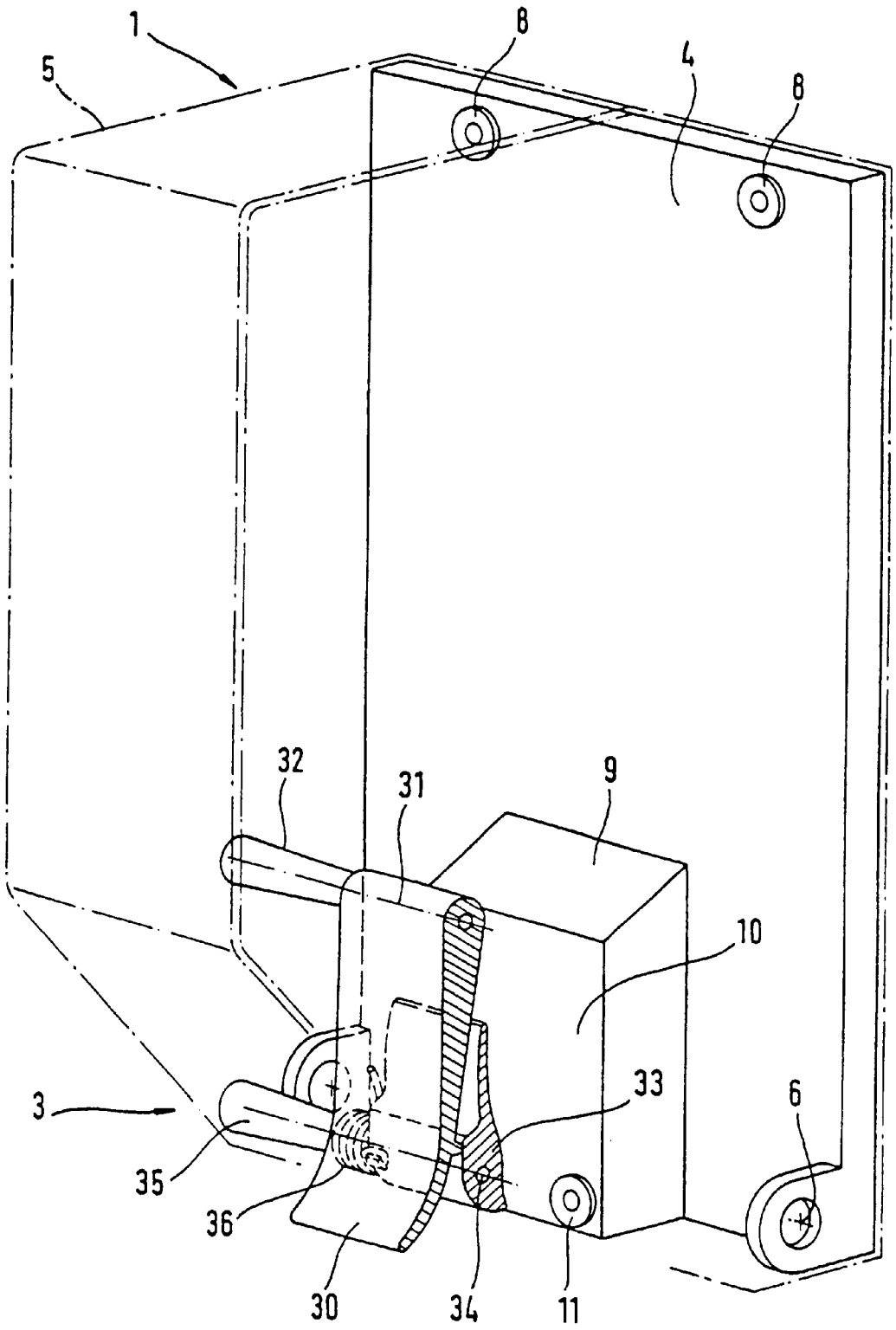
FIG. 1 shows a perspective illustration of the dispensing apparatus, partly in section.
Figure 6:
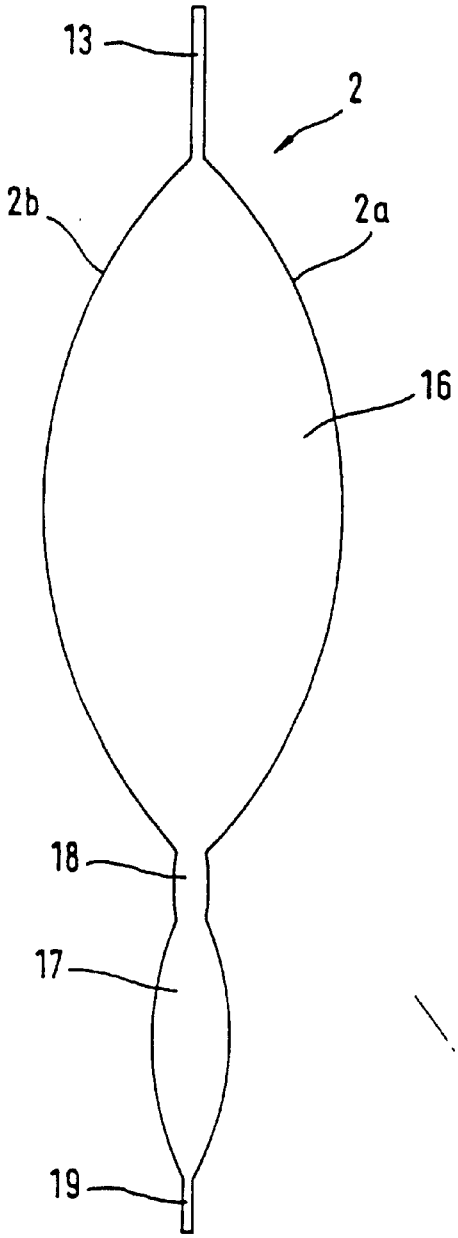
FIG. 6 shows a product bag, as seen from the side.

The dispensing apparatus has a housing 1, for accommodating a product bag 2 (FIG. 6), and a squeezing device 3, which is illustrated in FIGS. 1 to 4.

Figure 2:
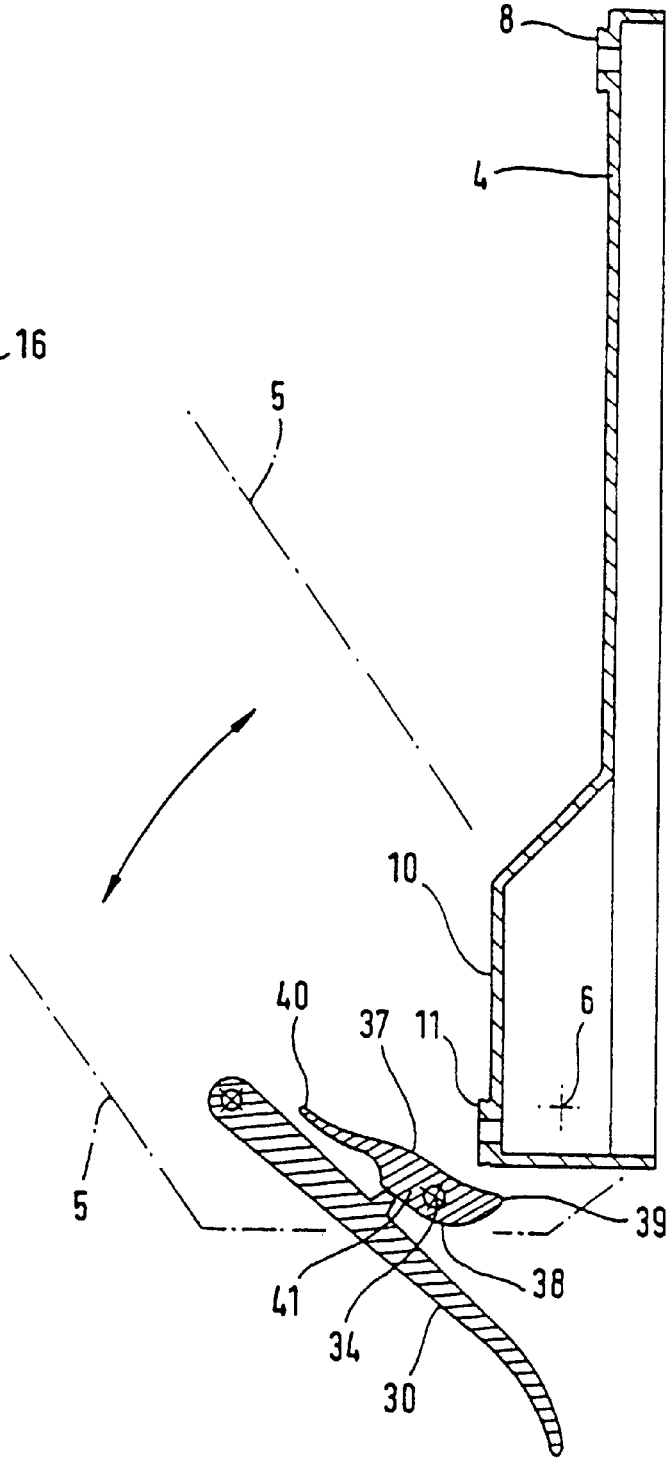
FIG. 2 shows a simplified section through the dispensing apparatus with the housing cover open.

The housing 1 comprises a housing rear wall 4 and a swing-action cover 5, which can be swung down about a horizontal axis 6 at the bottom border of the rear wall 4, as can best be seen from FIG. 2. In a variant of the housing, it is also possible for the cover to be pivoted about a lateral axis. It is also possible to swing it upward. In the open position of the cover, a product bag 2 can be hung in the unit, for which reason there are snap fasteners 7 on the unit bag and mating snap fasteners 8 on the housing rear wall 4. It is possible for the mating snap fasteners to be integrated firmly in the wall 4 or to be exchangeable. Moreover, the unit rear wall has a jutting-out portion 9 for providing an abutment wall 10, on which there are fitted further mating snap fasteners 11, which interact with snap fasteners 12 of the product bag 2. The jutting-out portion 9, with abutment wall 10, may also be formed by an extra part which is fastened on the rear wall 4.

Figure 5:
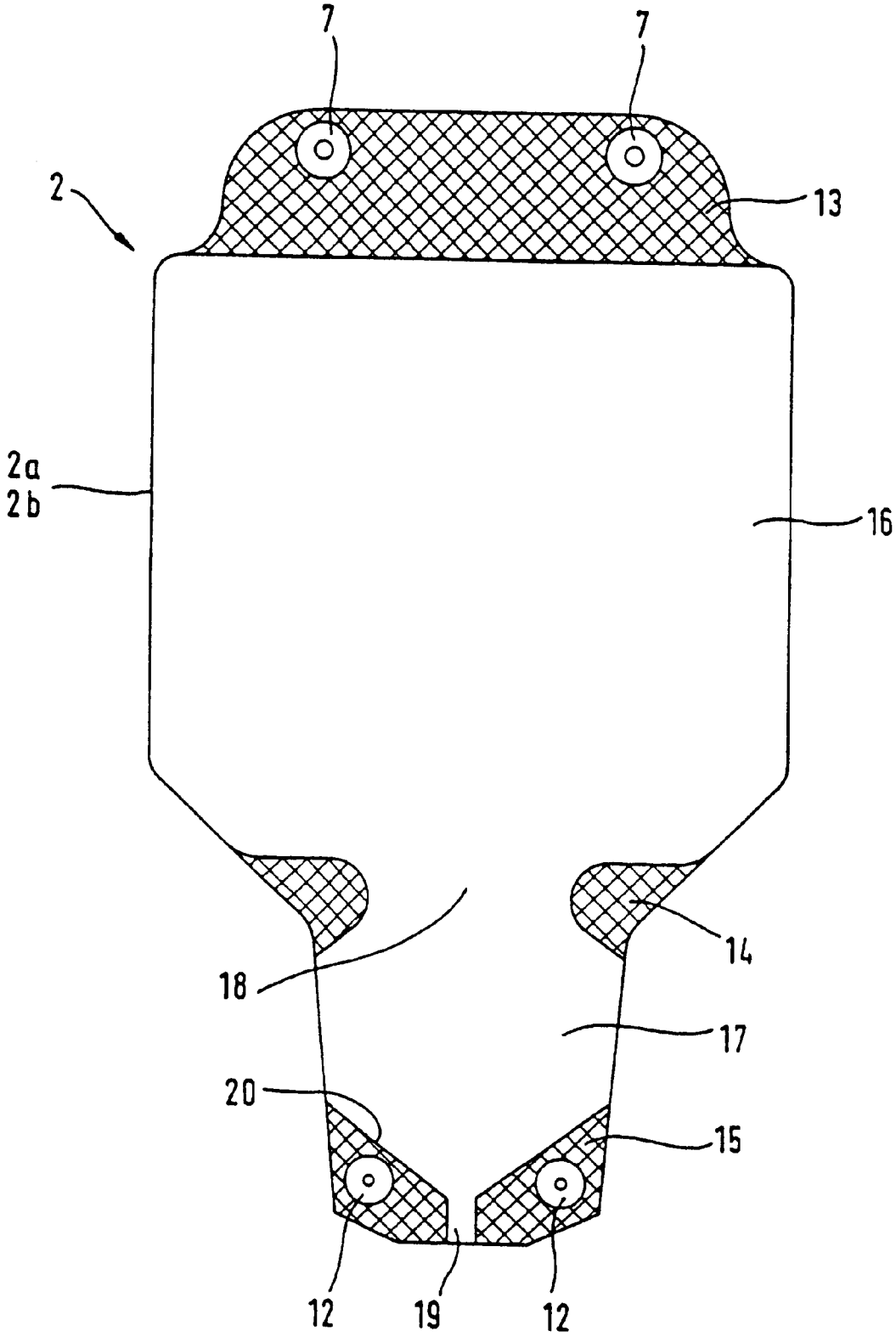
FIG. 5 shows an empty bag.

The product bag 2 is produced from two sheet-material blanks 2*a*, 2*b*, as can best be seen from FIG. 5. The sheet-material blanks are welded to one another at the border and also at surface-area locations which have been hatched in FIG. 5. This forms a top surface-area weld location 13 as a fastening strip, in which the snap fasteners 7 are seated. as well as two central surface-area constricting weld locations 14 and two bottom surface-area constricting weld locations 15. A supply chamber 16 is located between the surface-area weld locations 13 and 14 and an apportioning chamber 17 is located between the surface-area weld locations 14 and 15. A through-passage 18 is formed between the constricting weld locations 14 and an outlet or discharge passage 19 is formed between the constricting weld locations 15.

The surface-area shape of the sections 15 is generally rhomboidal, with the larger base wall on the outside and the smaller base wall on the inside, along the discharge passage 19. Oblique sides 20 of the rhombus lead in the direction of the outlet 19, which aids the operation of product flowing out without leaving any residues.

Figure 3:
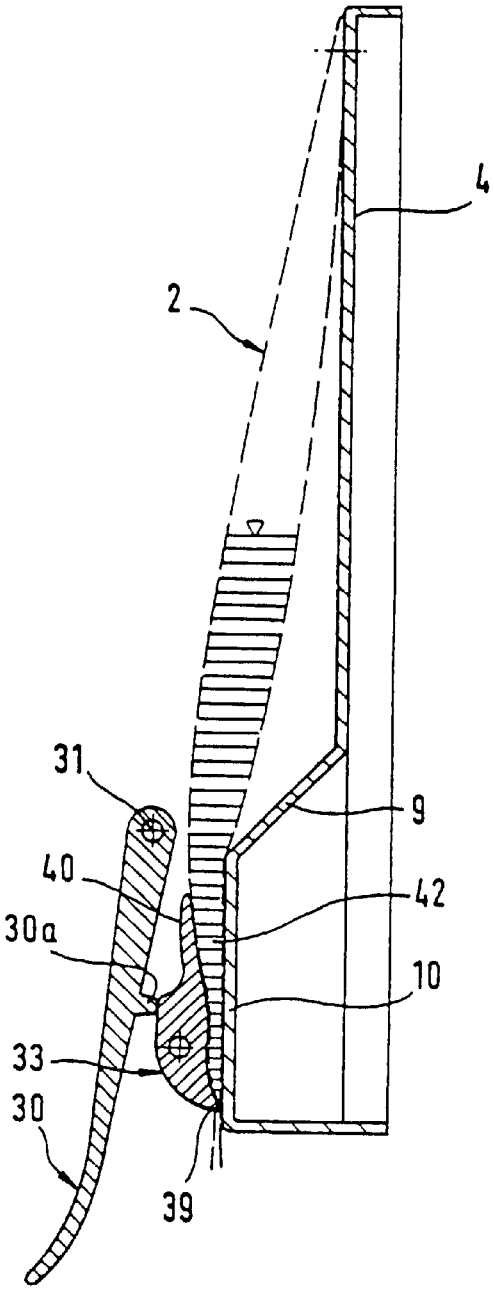
FIG. 3 shows the dispensing apparatus with the housing cover closed.

The squeezing device 3 comprises a hand lever 30 which is mounted such that it ran be pivoted about an axis 31, of which the ends are seated in bearing blocks 32 of the housing cover 5. The squeezing device 3 also comprises a pressure-exerting pivoting member 33 which is mounted such that it can be pivoted about the axis 34, of which the ends are seated in bearing blocks 35. A helical spring or bent spring 36 is clamped between the bearing block 35 and pressure-exerting pivoting member 33 in order to bias the latter in the counterclockwise direction in FIG. 3. The pressure-exerting pivoting member 33 is designed in the form of a non-symmetrical spindle in cross section and has a largely planar, slightly curved side 37 (FIG. 2) and a side 38 which is curved to a more pronounced extent, the two sides meeting at a bottom nose-like end 39 and tapering to an increasingly thin top end 40. The material of the pressure-exerting pivoting member is selected such that the increasingly thin end 40 forms an elastic lip. The axis 34 is located in a central thickened portion 41 and at such a distance from the abutment wall 10 that an interspace is formed between the side 37 of the pressure-exerting pivoting member 33 and the abutment wall 10. In the starting position of the dispensing apparatus, the space 42 tapers in a wedge-shaped manner in the direction of the nose 39 of the pressure-exerting pivoting member (FIG. 3). It thus follows the natural shape of the apportioning chamber 17, of which the outlet or discharge passage 19 is kept closed by the nose 39.

It is also possible for the pressure-exerting pivoting member to be constructed from a plurality of elements, for example the lip 40 may be produced from elastomeric material and be inserted into a relatively rigid plastic element 41.

Figure 4:
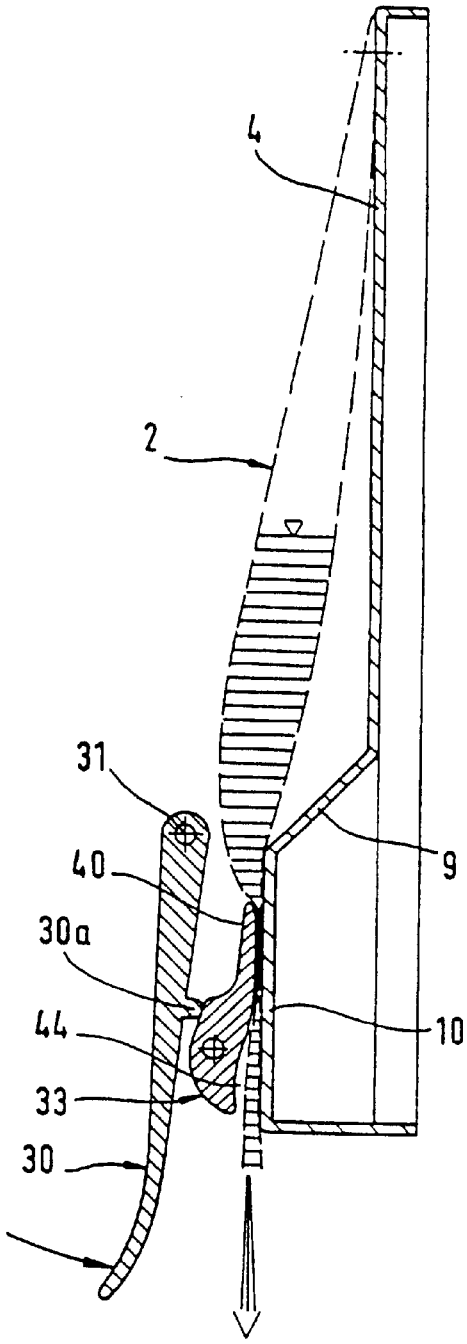
FIG. 4 shows the dispensing device during discharge of a portion of product.

The hand lever 30 has an actuating continuation 30*a* which can push onto the central portion 41 of the pressure-exerting pivoting member 33 in order to pivot the latter in the clockwise direction counter to the action of the spring 36 (FIG. 4). The conditions at the interspace 42 then reverse: the lip 40 bends back continuously and squeezes together the top region of the apportioning chamber 17, while the bottom region of the apportioning chamber widens. The interspace then takes on the downwardly widening shape 44 which is illustrated in FIG. 4.

The product located in the apportioning chamber 17 is squeezed out of the outlet opening 19 and discharged. The user will then release the lever 30, whereupon, as a result of the force of the spring 36, the pressure-exerting pivoting member 33 returns into the position illustrated in FIG. 3, in which the nose 39 closes the outlet passage 19 of the bag 2.

It can thus be appreciated that straightforward means achieve a dispensing action from the bag 2 and the outlet passage is closed reliably once a portion of the product has been discharged. The dispensing mechanism is of extremely straightforward construction and is functionally reliable. It is possible to use a straightforwardly constructed product bag which does not require its own sealing means when the outlet passage has been opened, because this outlet passage is blocked by the dispensing apparatus as soon as the dispensing action has been completed.

A further advantage of the novel dispensing apparatus resides in the straightforward method of attaching the product bag 2 to the unit rear wall 4. It is possible to use bag chains with tear-off lines between the bags, a top bag of the chain being suspended, and fastened, in the mating snap fasteners 8 by way of its top snap fasteners 7, whereupon the snap fasteners 12 are pressed into the mating snap fasteners 11. Once a top bag has thus been fastened on the unit rear wall 4, the cover 5 is closed and the nose 39 is positioned on the outlet passage 19 and clamps the bag firmly along the bottom tear-off line. This makes it easier to sever the fitted bag from the bag chain and, at the same time, the contents of the apportioning chamber of the bag are held back.

Figure 7:
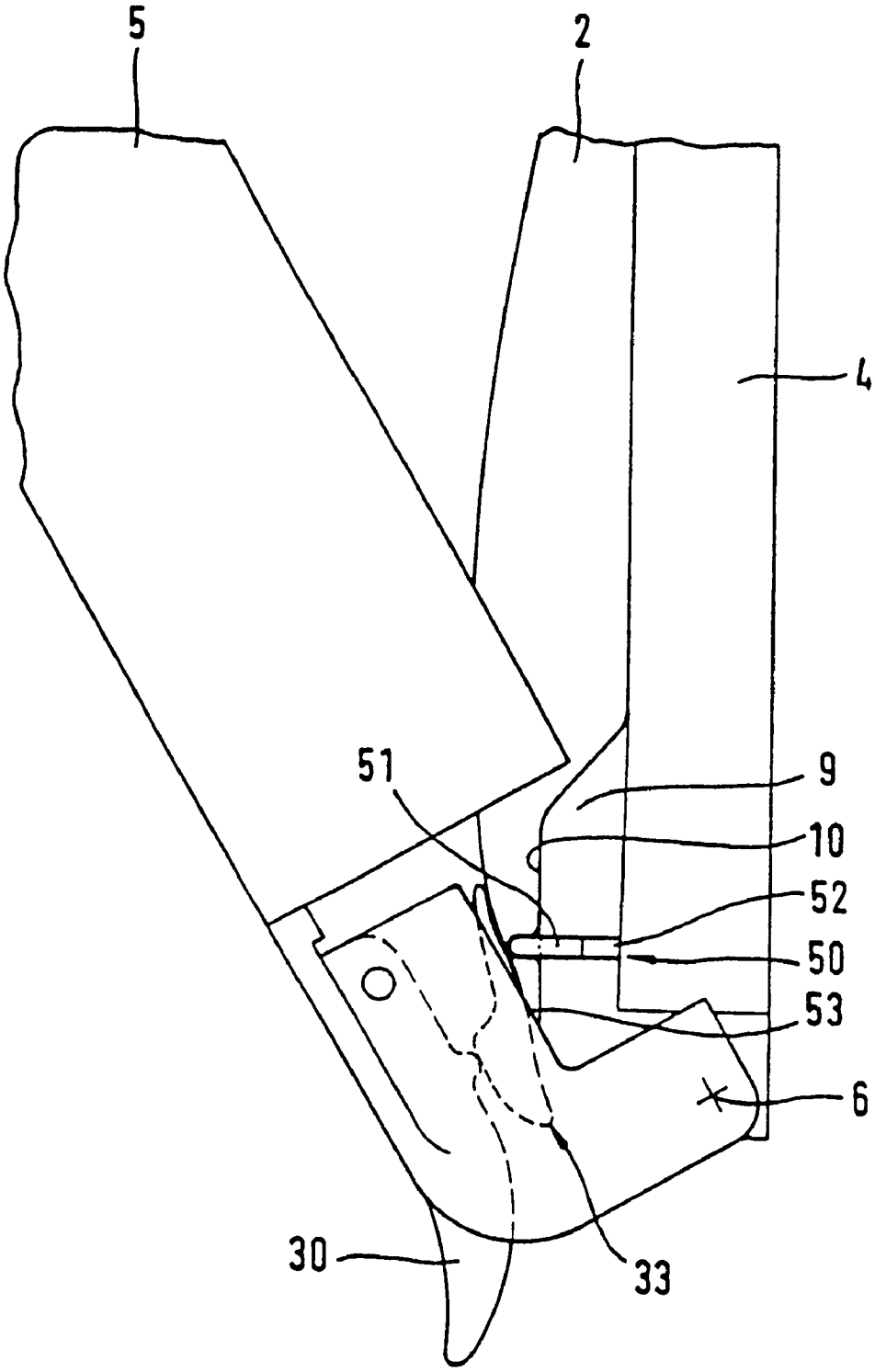
FIG. 7 shows a side view of the dispensing apparatus with a variant of the housing cover open.

FIG. 7 shows a side view of the dispensing apparatus with a discharge-prevention means 50. The latter comprises a clamping bar 51 which is mounted in a slot of the jutting-out portion 9 and is forced outward by a compression spring 52. The swing-action cover 5 is of shroud-like configuration and, on the side parts of the shroud, has edges 53 which can cooperate with the clamping bar 51. When the swing-action cover 5 is closed (position corresponding to FIG. 1), the edges 53 press the clamping bar 51 inward counter to the force of the compression spring 52, with the result that the front edge of the clamping bar 51 disappears behind the abutment wall 10. When, in contrast, the swing-action cover 5 is opened, as is illustrated in FIG. 7, the compression spring 52 forces the clamping bar 51 outward by way of its front end, which clamps the inserted bag 2 at its bottom end against the pressure-exerting pivoting part 33. This prevents product from being able to escape from the bag 2, even if the pressure-exerting pivoting member 33, as a result of the swing-action cover 5 being opened, has been pivoted out of abutment against the bottom end of the bag 2. When the swing-action cover 5 is closed, such a discharge-prevention means 50 is not required because the pressure-exerting pivoting member 33 then normally assumes its closing position and prevents contents from leaking out of the bag 2 unless the hand lever 30 is pressed and a portion of the bag contents is discharged.

I claim:

1. An apparatus for dispensing a product capable of flowing out of a bag, comprising:

a bag (2) comprising a supply chamber (16) and an apportioning chamber (17) comprising a top, and a bottom, a connecting passage (18) between the supply and apportioning chambers (16, 17) and a discharge passage (19), said bag having a suspender for suspending said bag in said dispensing apparatus (1);

a squeezing device (3) mounted on said dispensing apparatus (1) and comprising an abutment (10) for said bag and hand-actuated pressure members (30, 33) for clamping said bag (2) in a region of said apportioning chamber (17) and for squeezing said product in a direction of said discharge passage (19);

said abutment means (10) for said bag (2) comprising a stationary abutment wall (10) for supporting said apportioning chamber;

said hand-actuated pressure members (30, 33) comprising a hand lever (30) pivotably mounted about a first axis (31) to take on a first position and a second position, and a pressure-exerting pivoting member (33) pivotably mounted about a second axis (38);

said pressure-exerting pivoting member (33) being arranged at a predetermined distance from said abutment wall (10) and, in dependence on said first position of said hand lever (30) assumes a starting position, and in dependence on said second position of said hand lever (30), assumes a squeezing position, said predetermined distance forming a wedge shape (42) that in said starting position, has a thick end at the top and a thin end at the bottom of said apportioning chamber, and in the squeezing position, has a thin end at the top and a thick end at the bottom of said apportioning chamber.

2. The dispensing apparatus as claimed in claim 1, wherein said pressure exerting member (33) comprises a spindle that is non-symmetrical in cross section, comprising an increasingly thin top end (40), a thicker center region (41) and a bottom, nose-like end (39), said increasingly thin top end (40) forming an elastic lip and said pivot axis (34) being arranged in the region of said center region.

3. The dispensing apparatus as claimed in claim 2, wherein said first axis of said hand lever (30) is arranged parallel to, and above, said second axis (34) of said pressure-exerting pivoting member (33), and wherein said hand lever (30) comprises an actuating projection that interacts with said center region (41) of said pressure-exerting pivoting member (33) above said second axis (34) to pivot said elastic lip (40) in a direction of the abutment wall (10).

4. The dispensing apparatus as claimed in claim 1, wherein said pressure-exerting pivoting member (33) is spring-loaded into said starting position.

5. The dispensing apparatus as claimed in claim 1, further comprising a housing cover having an open position and a closed position, and a housing rear wall, said abutment wall (10) forming part of said housing rear wall (4), and said hand lever (30) and said pressure-exerting pivoting member (33) being mounted on said housing cover (5).

6. The dispensing apparatus as claimed in claim 5, wherein said housing rear wall has a bottom border, and said housing cover (5) is pivotably mounted about a third horizontal axis (6), extending parallel to, and in the vicinity of, said bottom border of said housing rear wall (4).

7. The dispensing apparatus as claimed in claim 5, wherein said housing rear wall (4) has a top border and, in the vicinity of the top border, a pair of snap-fasteners and, on said abutment wall a further pair of snap-fasteners, said snap-fasteners being adapted for suspending said bag in the dispensing apparatus (9).

8. The dispensing apparatus as claimed in claim 5, wherein said housing cover (5) is of shroud-like configuration and has a pair of lateral edges (53), said dispensing apparatus also comprising a leakage preventor comprising a slot in said abutment wall (10), a pinching bar (51) seated in said slot, a spring arranged to bias said pinching bar out of said slot abutting against said edges (53) of said housing cover (5) that in said closed position of said housing cover (5) forces said pinching bar (51) into said slot so as to put said pinching bar (51) out of operation, whereas, in said open position of said housing cover (5), said spring urge said pinching bar (51) onto said discharge passage at the bottom end of the bag (2) and against said pressure-exerting pivoting member (33), thus closing said discharge passage.

9. A bag including product which is capable of flowing, comprising:

a pair of sheet-material blanks (2*a*, 2*b*), each having a border in the shape of an upside-down bottle or pear, said blanks being welded to one another at their borders and over surface areas (13, 14, 15) which form a top weld (13) strip including first snap fasteners (7), a first pair of constricting weld (14) areas, and a second pair of constricting weld (15) areas, said top weld strip and said first pair of constricting weld areas together with said border welds, defining a supply chamber, said first pair of constricting weld areas and said second pair of constricting weld areas, together with said border welds, defining an apportioning chamber, a connecting passage being formed between said supply chamber and said apportioning chamber, and a discharge passage being formed in a region between said second pair of constricting weld areas, said second pair of constricting weld areas (15) each including an approximately rhomboidal surface area having a larger rhombus base side which is located at said border of the bag, a smaller rhombus base side which is adjacent to said discharge passage, and an upper oblique side, said upper oblique sides of said second pair of constricting weld areas forming a funnel leading into said discharge passage, and said second pair of constricting weld areas each including second snap fasteners, said first and second snap fasteners being adapted to fasten the bag on said dispensing apparatus.

* * * * *